United States Patent [19]

Llort et al.

[11] Patent Number: 4,715,607

[45] Date of Patent: Dec. 29, 1987

[54] GOLF BALL COMPOSITION

[75] Inventors: Francisco M. Llort, Dighton; Paul M. Gendreau, Swansea, both of Mass.; Raymond A. Berard, Portsmouth, R.I.

[73] Assignee: Acushnet Company, New Bedford, Mass.

[21] Appl. No.: 830,695

[22] Filed: Feb. 18, 1986

[51] Int. Cl.[4] ..... A63B 37/00; A63B 37/02; A63B 37/06

[52] U.S. Cl. ..... 273/218; 273/220; 273/228; 273/230; 524/908; 525/232

[58] Field of Search ..... 273/218, 220, 228, 230; 524/908; 525/232

[56] References Cited

U.S. PATENT DOCUMENTS

| | | | |
|---|---|---|---|
| 4,056,269 | 11/1977 | Poltitt et al. | 273/218 |
| 4,266,772 | 5/1981 | Martin et al. | 273/218 |
| 4,483,537 | 11/1984 | Hanada et al. | 524/908 |
| 4,546,980 | 10/1985 | Gendreau et al. | 524/908 |

FOREIGN PATENT DOCUMENTS

| | | | |
|---|---|---|---|
| 59-75932 | 4/1984 | Japan | 273/218 |

*Primary Examiner*—Allan M. Lieberman
*Attorney, Agent, or Firm*—Lucas & Just

[57] ABSTRACT

A solid golf ball is made using zinc diacrylate to cross-link polybutadiene. A small amount of zinc dimethacrylate is added and results in a golf ball of higher initial velocity. The amount of zinc dimethacrylate is between 0.1% to 2.0% by weight of the combined total of zinc diacrylate and zinc dimethacrylate. The golf ball product is suitably a one piece golf ball or the core of a two piece golf ball.

16 Claims, No Drawings

GOLF BALL COMPOSITION

The present invention relates to golf balls and in particular to an improved solid golf ball.

As used in the industry, the term "solid golf balls" refers to balls which do not have any windings, i.e. they are either unitary, one piece golf balls or are multiple piece golf balls, e.g. with a solid core and a separate cover.

The United States Golf Association (USGA) has set certain standards with respect to golf balls. The initial velocity of the golf ball is set at a maximum of 255 feet per second (250 feet per second with a 2% tolerance) when measured by USGA standards and golf ball manufacturers strive to come as close to this limit as possible without going over. However, it has proven most difficult to get the final few feet per second with solid balls. An improvement of about one-half foot per second is considered significant.

The golf industry has pretty much settled on one type of composition for use in solid golf balls to achieve the best properties. This composition is polybutadiene with a high cis-1,4-content cross-linked by zinc dimethacrylate or zinc diacrylate. Of these two cross-linkers, zinc diacrylate has been found to produce golf balls with greater initial velocity than zinc dimethacrylate.

The applicant has discovered that an improved solid golf ball can be made by using zinc diacrylate to cross-link the polybutadiene together with a small amount of zinc dimethacrylate as a second cross-linker. A golf ball thus obtained has higher initial velocity and compression than is obtainable with either cross-linker individually. This is most surprising, since a 50:50 blend of the two cross-linker produces a golf ball which is substantially worse in terms of initial velocity than either zinc diacrylate or zinc dimethacrylate alone.

To form the core of a two piece golf ball in accordance with the standard industry technique today, a mixture of polybutadiene and either zinc diacrylate or zinc dimethacrylate is mixed in an internal mixer as a result of which the mixture reaches an elevated temperature. Once the mixing is complete the admixture is cooled to a temperature below that of the decomposition temperature of the free radical initiator to be used and then the free radical initiator is added to the cooled mixture. This mixture is then mixed in an internal mixer after which it is removed and milled to a relatively thin sheet. Slugs of appropriate size are cut from the sheet and then formed into a golf ball product in a heated mold.

The free radical initiator is used to initiate crosslinking between the polybutadiene and the zinc diacrylate or zinc dimethacrylate. The free radical initiator is suitably a peroxide compound such as dicumyl peroxide.

It has now been discovered that by using a small amount of zinc dimethacrylate with zinc diacrylate, a golf ball product can be made having a higher initial velocity and a higher PGA compression than that of golf balls using zinc dimethacrylate or zinc diacrylate alone. This is an especially surprising and unexpected result because zinc diacrylate is known to give a faster ball than zinc dimethacrylate. Thus, the addition of zinc dimethacrylate to a golf ball containing predominately zinc diacrylate would be expected to give a slower ball than a ball made with zinc diacrylate alone. However, the addition of a small amount of zinc dimethacrylate to a golf ball composition using predominately zinc diacrylate as the crosslinker results in a golf ball that has a higher initial velocity than one which contains only zinc diacrylate.

Where improved initial velocity is not necessary in a particular application, the present invention can be used to increase durability. Because a golf ball made in accordance with the present invention has a greater initial velocity than conventional golf balls, material which increases durability can be added. While this will lower the initial velocity to that of a conventional golf ball, the final golf ball will have greater durability than conventional golf balls. A suitable material to increase durability is natural rubber.

As used herein, the term "golf ball product" is generic and includes unitary golf balls, cores of two piece golf balls, covers of two piece golf balls, centers of wound golf balls and the like. The present invention may be used to form a unitary golf ball or a two or more part golf ball if desired. The composition of the present invention may be used for either the core or the shell cover of a two piece ball but best results are obtained when the composition of the present invention is used as the core with a standard cover such as of Surlyn ionomer resin.

A typical base composition in accordance with the present invention comprises polybutadiene and, in parts by weight based on 100 parts polybutadiene, 30–40 parts zinc diacrylate as a crosslinker and 0.1–1.0 parts of a free radical initiator. Up to 40 parts by weight zinc oxide or other inert filler to adjust weight is preferably also included. The polybutadiene preferably has a cis 1,4 polybutadiene content above 40% and more preferably above 90%.

The amount of zinc dimethacrylate to be added to the base composition ranges from about 0.1% to about 2.0% based on the total weight of crosslinkers in the base composition. All percentages used herein when referring to zinc dimethacrylate are expressed as a percentage based on the total weight of the crosslinkers, i.e. the ratio of weight of zinc dimethacrylate divided by the total weight of zinc dimethacrylate and zinc diacrylate times 100.

A preferred amount of zinc dimethacrylate to use in the present invention is from about 0.25% to about 0.75% with a more preferred amount being about 0.33%.

In forming a composition according to the present invention, the polybutadiene, zinc dimethacrylate and zinc diacrylate are mixed together. When the components are initially mixed together the temperature of the mixture rises. The mixing is continued until a good dispersion is achieved as indicated by reaching a temperature of about 225° to 325° F. This is generally about 3 to 30 minutes. Once the mixing is complete the admixture is cooled to a temperature below the decomposition temperature of the free radical initiator. The initiator is added to the mixture, and the mixture is again mixed for about 3 to 15 minutes. The mass is then suitably milled into slabs or extruded into rods from which pieces are cut slightly larger and heavier than the desired golf ball product. These pieces are placed in a heated golf ball product mold such as a ball cup mold or a ball core mold and cured at elevated temperature under pressure. A temperature of about 280° F. to 320° F. for a period of about 15 to 30 minutes has been found to be suitable. The pressure is not critical so long as it is sufficient to prevent the mold from opening during heating and curing.

These and other aspects of the present invention may be more fully understood with reference to the following examples.

EXAMPLE 1

This example illustrates the synergistic result of a one piece solid golf ball made in accordance with the present invention as compared to one piece solid golf balls made using crosslinkers of zinc dimethacrylate alone, zinc diacrylate alone and a 50:50 mixture of zinc diacrylate and zinc dimethacrylate. Table I shows the parts by weight for each ingredient per 100 parts of polybutadiene along with the initial velocities of the resulting golf balls.

TABLE I

| Ingredients | 100% ZA | 100% ZM | 50:50 ZM:ZA | Present Invention |
|---|---|---|---|---|
| Polybutadiene | 100 | 100 | 100 | 100 |
| Zinc diacrylate (ZA) | 36 | — | 18 | 34.82 |
| Zinc dimethacrylate (ZM) | — | 34 | 17 | 0.18 |
| Zinc Oxide | 12 | 13 | 12.5 | 12.5 |
| Vulcup | 0.2 | 0.8 | 0.5 | 0.2 |
| Initial Velocity (ft/sec) | 253.3 | 249.7 | 249.7 | 253.8 |

Vulcup is $\alpha$, $\alpha$-bis (t-butylperoxy) diisopropyl benzene which is used as a free radical initiator. The polybutadiene had above a 90% cis 1,4 polybutadiene content. Zinc oxide is a standard filler used in golf balls.

The golf balls of Table I were made by mixing the polybutadiene, zinc oxide and crosslinker in a Shaw intermix for about six minutes, at which point the mixture had reached a temperature of about 250° F. After the mixture had reached about 250° F. it was removed from the mixer and cooled to ambient temperature with the aid of passing it through a two roll mill. The mixture was placed back in the mixer and then the Vulcup was added and mixed for an additional two minutes. Thereafter, the composition was removed and banded on a standard two roll mill to form a slab about one-eighth of an inch thick.

Pieces of the slab were rolled and cut to form blanks of about 48 grams each. The blanks were placed in a standard one piece golf ball mold. The mold was closed under 60,000 pounds pressure at a temperature of about 320° F. and the composition was held under this temperature and pressure for about 20 minutes. Thereafter, the balls were removed from the mold and were allowed to stand for 24 hours at room temperature.

The velocities shown in Table I are comparable to those obtained in the standard USGA test. It is readily apparent that the admixture of the present invention produces a golf ball with a higher initial velocity as compared to any of the other compositions listed in Table I.

As shown above, the golf ball made using 100% zinc dimethacrylate as a crosslinker produces a ball of slower initial velocity than the ball crosslinked with zinc diacrylate alone. Thus, it would be expected that a golf ball using both zinc diacrylate and zinc dimethacrylate as crosslinkers would produce a ball with less initial velocity than a ball using zinc diacrylate alone. This expectation is verified by the fact that the 50:50 mixture of zinc diacrylate and zinc dimethacrylate does produce a ball with much less initial velocity than the zinc diacrylate ball. However, where the amount of zinc dimethacrylate added is small as compared to the amount of zinc diacrylate, a golf ball is obtained which has a high initial velocity as compared to either one of the materials alone.

EXAMPLES 2-9 It has been found that the present invention produces even more improvement in golf ball cores. Golf ball cores in accordance with the present invention were made and tested. Table II shows the amount of various ingredients used to make the cores expressed in parts by weight per 100 parts of polybutadiene.

TABLE II

| Ingredients | Parts Example 2-9 |
|---|---|
| Polybutadiene | 100 |
| Total Zinc dimethacrylate (ZM) and Zinc diacrylate (ZA) | 31 |
| Zinc oxide | 22 |
| Trimethylol propane trimethacrylate | 3 |
| Yellow dye | 0.4 |
| Vulcup | 0.2 |

Zinc oxide is a filler and yellow dye was added for identification purposes only. Trimethylol propane trimethacrylate is a processing aid. Vulcup is a radical initiator as identified in Example 1 above.

The ingredients without the initiator and the trimethylol propane trimethacrylate were mixed in a Shaw intermix for about 6 minutes at which point the mixture had reached a temperature of about 250° F. The mixture was cooled to ambient temperature with the aid of passing it through a two roll mill. The mixture was placed back in the mixer, then the Vulcup and trimethylol propane trimethacrylate were added and were mixed for an additional 2 minutes. Thereafter, the composition was removed and banded on a standard two roll mill to form a slab about one-eighth of an inch thick. Pieces of the slab were rolled and cut to form blanks weighing about 38 grams each. The blanks were placed in a standard golf ball core mold. The mold was closed under 60,000 pounds pressure at a temperature of about 320° F. and the composition was held under this temperature and pressure for about 20 minutes. Thereafter, the cores were removed from the mold and were allowed to stand for 24 hours at room temperature. The cores were tested for initial velocity and PGA compression. Table III indicates the % of zinc dimethacrylate (ZM) as a percentage of the total of the zinc diacrylate/zinc dimethacrylate content and also includes the results of the tests.

TABLE III

| Example | % ZM | Initial Velocity (ft/sec) | PGA Compression |
|---|---|---|---|
| 2 | 0.0 | 250.9 | 62 |
| 3 | 0.2 | 252.0 | 70 |
| 4 | 0.5 | 251.7 | 71 |
| 5 | 0.7 | 252.1 | 71 |
| 6 | 1.0 | 251.9 | 72 |
| 7 | 3.0 | 249.3 | 60 |
| 8 | 5.0 | 247.5 | 53 |
| 9 | 10.0 | 248.2 | 53 |

The velocities obtained are comparable to those obtained in the standard United States Golf Association (USGA) test. The PGA compression rating was obtained using a commercial PGA compression tester. Both of these measurement techniques are standard throughout the golf industry and are well known to those skilled in the art of golf ball manufacturing.

It is readily apparent that the addition of a small amount of zinc dimethacrylate to a core made with zinc diacrylate as the predominate crosslinker gives superior results. The results are truly unexpected and surprising.

EXAMPLES 10–15

One piece solid golf balls were prepared using composition as shown in Table IV below. Table IV shows the amounts of the various ingredients used expressed in parts by weight per 100 parts of polybutadiene.

TABLE IV

| Ingredients | Parts Example 10–15 |
|---|---|
| Polybutadiene | 100 |
| Total Zinc dimethacrylate (ZM) and Zinc diacrylate (ZA) | 35 |
| Zinc oxide | 12.5 |
| Vulcup | 0.2 |

These solid one piece golf balls were made following the procedure as outlined in Example I above. The finished balls were tested for initial velocity and PGA compression. Table V shows the % of zinc dimethacrylate based on the total amount of crosslinker and also sets forth the test results.

TABLE V

| Example | % ZM | Initial Velocity (ft/sec) | PGA Compression |
|---|---|---|---|
| 10 | 0.0 | 253.2 | 89 |
| 11 | 0.5 | 253.8 | 91 |
| 12 | 1.0 | 253.6 | 82 |
| 13 | 2.5 | 251.9 | 85 |
| 14 | 5.0 | 250.6 | 86 |
| 15 | 10.0 | 249.9 | 75 |

As can be seen from Table V, a superior golf ball is made from a golf ball containing predominately zinc diacrylate as the crosslinker with only a small amount of zinc dimethacrylate. Note also that using more than 2% zinc dimethacrylate actually causes a decrease in initial velocity as compared to the initial velocity of golf balls made with zinc diacrylate as the only crosslinker. It will be understood that the claims are intended to cover all changes and modifications of the preferred embodiments of the invention, herein chosen for the purpose of illustration, which do not constitute departure from the spirit and scope of the invention.

What is claimed is:

1. In the method of making a golf ball product from an admixture of polybutadiene having a cis-1,4-polybutadiene content of above about 40% and, per 100 parts polybutadiene, from about 30 to about 40 parts zinc diacrylate, and from about 0.1 to about 1.0 parts free radical initiator, the improvement comprising the inclusion of from about 0.1% to about 2.0% of zinc dimethacrylate by weight of the combined weight of zinc diacrylate and zinc dimethacrylate.

2. The method of claim 1 wherein the zinc dimethacrylate is present in the amount of from about 0.25% to about 0.75%.

3. The method of claim 1 wherein said polybutadiene has a cis 1,4 polybutadiene content above about 90%.

4. The method of claim 1 wherein the golf ball product is a unitary golf ball.

5. The method of claim 1 wherein the golf ball product is a golf ball core.

6. A golf ball product formed from a mixture comprising polybutadiene having a cis-1,4-polybutadiene content of above about 40% and, per 100 parts polybutadiene, from about 30 to about 40 parts zinc diacrylate, and from about 0.1 to about 1.0 parts free radical initiator, and further comprising from about 0.01% to 2.0% zinc dimethacrylate by weight of the combined weight of the zinc diacrylate and zinc dimethacrylate.

7. The golf ball product of claim 6 wherein the zinc dimethacrylate is present in the amount of from about 0.25% to about 0.75%.

8. The golf ball product of claim 6 wherein said polybutadiene has a cis 1,4 polybutadiene content above about 90%.

9. The golf ball product of claim 6 wherein the golf ball product is a unitary golf ball.

10. The golf ball product of claim 6 wherein the golf ball product is a golf ball core.

11. A one piece solid golf ball comprising polybutadiene having a cis-1,4-polybutadiene content of above about 40% and, per 100 parts polybutadiene, about 30–40 parts by weight zinc diacrylate, and from about 0.1 to about 1.0 parts free radical initiator, and about 0.1% to 2.0% zinc dimethacrylate by weight of the combined total of zinc diacrylate and zinc dimethacrylate.

12. The golf ball of claim 11 wherein the zinc dimethacrylate is present in the amount of about 0.25%-0.75%.

13. The golf ball of claim 11 wherein the zinc dimethacrylate is present in the amount of about 0.33%.

14. A two piece golf ball comprising a core and a cover, the core comprising polybutadiene having a cis-1,4-polybutadiene content of above about 40% and, 100 parts polybutadiene, about 30–40 parts by weight zinc diacrylate, and from about 0.1 to about 1.0 parts free radical initiator, and about 0.1% to 2.0% zinc dimethacrylate by weight of the combine total of zinc diacrylate and zinc dimethacrylate.

15. The golf ball of claim 14 wherein the zinc dimethacrylate is present in the amount of about 0.25%-0.75%.

16. The golf ball of claim 14 wherein the zinc dimethacrylate is present in the amount of about 0.33%.

* * * * *

UNITED STATES PATENT AND TRADEMARK OFFICE

CERTIFICATE OF CORRECTION

PATENT NO. : 4,715,607

DATED : December 29, 1987

INVENTOR(S) : Francisco M. Llort et al.

It is certified that error appears in the above-identified patent and that said Letters Patent are hereby corrected as shown below:

Column 1, line 35, change "cross-linker" to --cross-linkers--.

Column 6, line 44, after "and," insert --per--.

Signed and Sealed this

Fourteenth Day of June, 1988

*Attest:*

DONALD J. QUIGG

*Attesting Officer*

*Commissioner of Patents and Trademarks*